United States Patent [19]

Cleland

[11] Patent Number: 5,000,352

[45] Date of Patent: Mar. 19, 1991

[54] BEVERAGE DISPENSING APPARATUS

[76] Inventor: Robert K. Cleland, 11051 Via El Mercado, Los Alamitos, Calif. 90720

[21] Appl. No.: 401,656

[22] Filed: Aug. 31, 1989

[51] Int. Cl.[5] ..... B67D 5/56

[52] U.S. Cl. ..... 222/129.2; 222/56; 222/66

[58] Field of Search ..... 222/56, 66, 71, 129.1-133; 137/893; 417/151, 198; 239/310, 318

[56] References Cited

U.S. PATENT DOCUMENTS

| | | | |
|---|---|---|---|
| 3,323,681 | 6/1967 | DiVette et al. | 222/129.3 X |
| 4,160,512 | 7/1979 | Cleland | 222/129.2 X |
| 4,186,772 | 2/1980 | Handleman | 137/893 X |
| 4,469,137 | 9/1984 | Cleland | 222/133 X |
| 4,544,084 | 10/1985 | Cleland | 222/129.2 X |
| 4,684,332 | 8/1987 | Hartley et al. | 91/350 X |
| 4,795,061 | 1/1989 | Peckjian | 222/129.2 X |
| 4,901,765 | 2/1990 | Poe | 137/893 |

*Primary Examiner*—Andres Kashnikow
*Assistant Examiner*—Kenneth R. DeRosa
*Attorney, Agent, or Firm*—Georges A. Maxwell

[57] ABSTRACT

A beverage making and dispensing apparatus comprising a pressurized water supply; a non-pressurized beverage syrup supply; a hydraulically driven proportional pump with water and syrup inlets connected with the water and syrup supplies, water and syrup outlets connected with a water delivery line and a syrup delivery hose; an aspirator-atomizer mixing device with an elongate mixing chamber with an outlet end, a water passage with an inlet end connected with the water delivery line and a nozzle end to direct a jet of water longitudinally of the chamber toward its outlet end, a syrup port communicating with the chamber and connected with the hose; a water valve to start and stop the flow of water from the pump into and through the mixing device; and, a flow control device in the hose downstream of the pump and upstream of the syrup port to establish a pressure drop and maintain a positive pressure at the syrup outlet of the pump that is less than the minus pressure at the syrup port and a pressure at the syrup port that is less than the water pressure at the nozzle end of the water passage.

10 Claims, 3 Drawing Sheets

P
30
31
70
30'
42
43
44
D
40
T
I
F
31'
24
12
14
C.P.
13
10
12
19
18'
18
17
W
S
16
15
B
G
71
ON
OFF
PRIME

BEVERAGE DISPENSING APPARATUS

BACKGROUND OF THE INVENTION

In the art of commercially vending and dispensing beverages at restaurants, lunch stands and the like, there are two notably different kinds of beverages that are made on the premises, sold and dispensed. One of those kinds of beverages are carbonated beverages, such as root beer and colas that are made by mixing together predetermined portions of beverage concentrate or syrup and carbonated water. The other kind of beverages are noncarbonated fruit punches or ades, such as lemonade that are made by mixing together properly portioned volumes of beverage concentrate or syrup and noncarbonated or plain water.

In the case of carbonated beverages, the syrup and carbonated water are made a serving portion at a time, since those beverages will release gas and go "flat" if made in advance and let to stand. In the case of noncarbonated beverages, it is common practice to make them in substantial multi-serving batches and to display and utilize the pre-made beverages for sales promoting purposes.

In the case of carbonated beverages, the water and syrups are preferably and, in most instances, chilled by suitable refrigeration means before they are combined and mixed together, while in the case of noncarbonated beverages the water the syrups are not chilled before being combined and mixed together. Instead, the finished beverages are chilled by suitable refrigeration means while held in supply, ready to be dispensed.

As a result of the above and other factors that I have not recited, two distinct kinds of beverage making and dispensing apparatus and/or machines are provided by the prior art: one for carbonated beverages and the other for noncarbonated beverages.

In the case of carbonated beverages, the basic apparatus provided by the prior art to make and dispense the beverages includes a carbonated water supply means with refrigeration means to chill the supply of carbonated water and that is suitably pressurized to effect delivery of the carbonated water in and through the apparatus; a syrup supply and a suitable pump or other form of syrup transporting means to deliver syrup downstream through the apparatus; and, a normally closed manually operable duplex mixing and dispensing valve downstream of and connected with the water and syrup supplies and that operates to mix together portioned volumes of water and syrup and to deliver beverage when manually opened. The mixing and dispensing valves are normally elevated so that a serving glass or the like can be positioned beneath them and into which beverage dispensed by them is drained. Such dispensing valves are commonly provided with multi-ported water and syrup nozzles that cause the water and syrup to substantially mix together prior to their being dispensed thereby. The carbonated water and syrup supplies for the above kind of carbonated beverage mixing and dispensing apparatus are generally quite large and unsightly and are hidden from view beneath a serving counter or the like in the establishments in which they are used, while the dispensing valves of such apparatus are, as a general rule, housed within the upper end portions of upwardly projecting decorative columns or "towers" mounted atop the counters. According the water and syrups must be transported a substantial distance from their sources to the dispensing valves.

The principal difficulties and/or problems associated with the above noted kind of carbonated beverage dispensing apparatus resides in the fact that the water and syrup must be properly proportioned to assure making beverages of proper and predetermined strength. In efforts to assure proper proportioning of water and syrup, the prior art utilizes pressure regulators to establish and maintain predetermined pressures on both the water and syrups within the apparatus and utilizes various fixed and/or adjustable flow metering valves and the like throughout the apparatus that must, from time to time, be adjusted and set to assure the making and dispensing of properly finished beverages.

In the case of noncarbonated fruit punches and the like, the prior art provides beverage dispensing machines that are characterized by decorative box-like housings that are intended to be set atop a serving counter or the like in the establishments in which the machines are used; and, transparent beverage supply tanks carried by and projecting up from the housings and in which supplies of finished beverages are held for display purposes and ready to be dispensed. The housings accommodate refrigeration means to chill the beverages in the tanks and accommodate or house beverage circulating means that operate to keep the beverages in the tank circulating for display purposes and so that the water and syrups are not subject to separating. The machines have manually operable dispensing valves that communicate with the bottoms of the supply tanks and through which beverages, within the tanks, are let to drain into awaiting glasses or the like.

The beverage circulating means provided to keep the beverages in the tanks circulating commonly consist of motor-driven magnetic drive coupling parts in the housings of the machines, below flat horizontal bottom walls of the supply tanks of the machines and impellers with magnetic-driven coupling parts in the tanks and rotatably supported atop the bottom walls thereof, above and in driving relationship with the drive coupling parts. While the magnetic coupling means utilized in the art are sufficiently "strong" to drive the impellers enough to keep the beverages worked upon from becoming static and such that separation of the ingredients of the beverages will not occur, they are not so strong that the impellers can be effectively utilized to effect initial mixing together of the water and syrups that are used to make the beverages.

Many thousands of dispensing machines of the general character referred to above are in use today. In the case of a large percentage of those machines, it is necessary and common practice for the users of the machines to mix together the necessary volumes of water and concentrate to make a batch of beverage in separate batch or mixing containers and to pour the beverages made therein into the supply tanks of the machines, as circumstances require. In the case of other beverage dispensing machines, the machines are equipped with various automatic and/or semi-automatic mixing means and/or devices that operate to mix together properly proportioned volumes of water and syrup and to deliver finished, or substantially finished, beverages into the supply tanks of the machines. Many of those automatic or semi-automatic mixing means are made to operate in response to the liquid level of the beverages in the tanks of their related machines and work to maintain the tanks substantially full at all times.

The effectiveness of the various kinds of automatic mixing means for beverage dispensing machines provided by the prior art varies widely. A principal shortcoming that is found to exist in many automatic mixing means resides in the fact that they do not work to thoroughly and effectively mix together the water and syrup conducted therethrough and instead dump and/or deliver unmixed water and syrup into the tanks of the their related machines. In such cases, the beverage circulating means in the tanks of the machines is utilized to effect and finish mixing all the water and syrups. Due to the inherent inefficiency and/or weakness of most beverage circulating means, it is not infrequent that the machines must be put out of service for unacceptable protracted periods of time to enable the materials to become mixed. The foregoing problem is commonly overcome by the users of such machines resorting to mixing the water and syrups in the tanks of their machines by means of mixing boards and/or paddles.

The most effective and efficient mixing means for beverage dispensing machines that prior art provides are those means which utilize and/or which are characterized by aspirator-atomizer mixing and dispensing devices that are positioned above or within the upper portions of the supply tanks of their related beverage dispensing machines; to which water, under controlled pressure and from remote high pressure water supplies, is delivered and which works to draw metered (properly proportioned) volumes of syrup from remote syrup supplies. The complete mixing of water and syrup in and the delivery of finished beverage from those devices is insured by the atomizing function performed thereby.

The principal shortcoming that exists in the great majority of those aspirator-atomizer mixing devices utilized in beverage dispensing machines resides in the fact that the ability of those devices to draw or lift the syrups worked upon any appreciable distance and yet remain effective to properly meter the syrups has proven to be limited and such that their related syrup supplies must be kept as high and as close to the tops of the supply tanks of the machines as is possible. This materially limits the ability to locate the syrup supplies remote from the machines, where they can be hidden from view.

In the beverage making and dispensing art, the ratio of water and syrup used to establish a properly finished beverage has become standardized at 5:1. The ratio of water and syrup is generally measured by the sugar content of the finished beverage and is commonly called or referred to as the BRIX measurement. If the sugar content is proper, "BRIX" is said to be proper. If the beverage has too much or too little sugar, it is said to be "above BRIX" or "below BRIX."

It is to be noted that in the case of carbonated beverages, the syrups are characteristically and necessarily free of all fibrous and solid materials. While in the non-carbonated fruit flavored beverages and the like, the syrups are often heavily ladened with fruit fibers and solid materials. As a result of the foregoing, those aspirator-atomizer type mixing devices referred to above are exceedingly effective to work upon fiber ladened beverage syrups since they are not subject to being plugged or fouled thereby. On the other hand, the above noted dispensing valves with multi-ported nozzles that are used in carbonated beverage dispensing apparatus cannot freely conduct and are so likely to be fouled or plugged by small traces of fruit fiber or the like that they cannot be satisfactorily used to handle or work upon those many fruit beverage syrups that contain fruit fiber and the like.

Until recently, the manufacturers of beverage syrups sold syrup in quart, half gallon and gallon containers (bottles and cans) that were sufficiently small and light so that they were easy to manually manipulate and, in most instances, not so large that adequate room could not be found to position them in close working position relative to their related beverage dispensing machines.

In the recent past, the manufacturers of beverage syrups have commenced to sell their syrups in large five-gallon "bag-in-a-box" containers at notably reduced cost. Bag-in-a-box containers consist of inexpensive plastic bladders or bags contained within and supported by inexpensive corrugated or pasteboard cartons or boxes. The boxes are vented and the bags therein are provided with fluid fittings accessible at apertures in one side of the boxes. The fluid fittings of bag-in-a-box containers are or include coupling parts designed to connect with mating coupling parts at the inlet ends of elongate syrup or suction hoses provided to conduct the syrups downstream from the containers. The fluid fittings are commonly provided with check valves or equivalent valving means that prevent leaking or spillage of syrup from within the bags and that are only unseated or open when the two mating coupling parts are connected, that is, when the coupling part on a related syrup hose is connected therewith.

In addition to the economic advantages afforded by bag-in-a-box packaging of beverage syrups, such packaging materially extends the shelf life of the syrups since during the period of time when syrups are being dispensed from those packages, the bags collapse within the boxes in a manner that prevents the introduction of air into the bags and resulting oxidation and spoilage of the syrups.

While the great majority of owners and users of non-carbonated beverage dispensing machines of the character referred to above are desirous of buying and using beverage syrups that are sold in bag-in-a-box containers, few can use such containers and gain the advantages afforded thereby because those containers are so large that they cannot be advantageously positioned within effective working distance from their machines.

In the art of carbonated beverage dispensing apparatus, the prior art now provides at least one proportional pump that operates to accurately deliver water and beverage syrup in predetermined ratio, such as five-to-one. That pump is particularly intended and suitable to effectively deliver syrup from a bag-in-a-box container and to deliver it, along with the water delivered thereby to remote locations, at high pressure, where the water the syrup are combined and mixed together to make beverages.

The above noted pump is the subject matter of U.S. Pat. No. 4,684,332, issued Aug. 4, 1987, for RATIO PUMP AND METHOD. The subject pump is made and sold by SHURFLO in Santa Ana, Calif., and is identified by its manufacturer as the BRIX PROPORTIONING PUMP. That pump is a duplex motor-pump structure characterized by a positive displacement double-acting piston and cylinder water pumping section and a pair of positive displacement piston and cylinder syrup pumping sections. The several cylinders are axially aligned and their related pistons are carried by a single or common rod. The effective cross-sectional area or displacement of the motor section is, for example, five times the effective cross-sectional area or displacement of the pump sections. The pump has water inlet and outlet fittings connected with water supply and delivery lines and has syrup inlet and outlet fittings connected with syrup suction or inlet and syrup delivery hoses. The water supply line connects with a suitable high-pressure water supply for the pump section. The water delivery line receives exhaust water from the pump section, which water is the portioned water delivered by the pump, and extends to a remote duplex mixing and beverage dispensing valve or the like. The suction hose connects with a supply of syrup in a bag-in-a-box container. The delivery hose extends to the duplex mixing and beverage dispensing valve.

The above pump is intended to be intermittently operated and is put into and out of operation by stopping and starting the flow of water to it as by means of the remote mixing and dispensing valve with which it is connected.

A special feature of the proportional pump is the provision of a pressure responsive water shut-off valve at the water inlet side of its motor section. The shut-off valve is responsive to the pressure at the suction or inlet side of the pump sections of the pump and is such that when the supply of syrup in the bag-in-the-box container is exhausted and the bag therein fully collapses, the minus pressure at the syrup inlet side of the pump drops or lowers materially and causes the valve to close. Without the above noted shut-off valve, upon the supply of syrup being exhausted, the pump would continue to deliver water. Further, under such circumstances the valves and seals of the pump section fail and are subject to being irreparably damaged.

Another characteristic of the subject proportional pump resides in the fact that if a minus pressure is applied to the syrup outlet side or fitting of the pump, the valves and/or seals in the pumping section or sections fail to function as intended and syrup is drawn through the pump, upsetting the ratio of water and syrup delivered by it.

There are those in the prior art who have sought to use the above noted proportional pump to intermittently deliver properly portioned volumes of water and syrup into the supply tanks of non-carbonated beverage dispensing machines of the character referred to above. In doing so, the syrup hoses and water lines extending from the pumps are extended to and made to open into the tops of the supply tanks of the machines. While this practice is effective to deliver proper portions of water and syrup into the supply tanks, the ingredients are not mixed and the heavier syrups drop to the bottom of the tanks. Accordingly, the ingredients must be manually mixed together in the tanks or the operators of the machines must temporarily terminate the sale and dispensing of beverages for sufficient and often protracted periods of time to let the beverage circulating means of the machines effect mixing of the ingredients.

In furtherance of the above, float-controlled water shut-off valves have been engaged on the ends of the water lines within the tanks so that the pumps are made to intermittently operate and maintain the supply of liquids in the tanks at predetermined levels.

In an experiment conducted while developing the present invention, I connected an aspirator-atomizer type mixing device with and between the delivery ends of the water delivery line and syrup delivery hose extending from a proportional pump and arranged that device in the top of a syrup supply tank of a beverage dispensing machine with the intent to effect complete mixing of the water and syrup delivered by the pump, before discharging those liquids into the tank. The foregoing proved to be totally ineffective since the minus pressure generated by the aspirator-atomizer mixing device imposed upon the syrup in the syrup delivery hose and at the syrup outlet of the pump worked to draw excessive syrup through the proportional pump and rendered it ineffective for its intended purpose.

OBJECTIVE AND FEATURES OF MY INVENTION

It is an object of this invention to provide improved water and beverage syrup mixing means in combination with a non-carbonated beverage dispensing machine with a beverage supply tank and a proportional pump remote from the machine and operating to deliver properly portioned volumes of water and syrup to the beverage supply tank.

It is an object and feature of the invention to provide the combination set forth above wherein the mixing means includes an aspirator-atomizer mixing device with a water inlet receiving water from the pump, a syrup inlet receiving syrup from the pump, and a beverage outlet opening into the beverage supply tank above the supply of beverage therein; and, a syrup flow control means between the pump and the aspirator-atomizer device operating to maintain positive pressure on the syrup upstream thereof and a pressure on the syrup downstream thereof at a pressure sufficiently less than the pressure on the water delivered to the device to effect atomizing of the syrup and water within the device.

Yet another object and feature of the invention is to provide an aspirator-atomizer mixing device of the general character referred to above that includes an electrically operated on-and-off valve to start and stop the flow of water into and through the device and that included a beverage delivery tube in which atomized water and syrup are combined to establish finished beverage and from which the finished beverage drains.

It is yet another object and feature of the invention to provide an aspirator-atomizer mixing device of the general character referred to above in combination with a proportional pump of the general character referred to above wherein the pump is put into and out of operation by starting and stopping the flow of water issuing from the pump at the downstream side thereof and such that operation of the combination to make and deliver beverage is controlled by opening and closing of the valve of said mixing device.

Finally, it is an object and feature of the invention to provide switching means to control opening and closing of the electrically operated valve of the mixing device that is responsive to the level of liquid in the beverage supply tank and that causes the valve to open when the liquid level reaches a predetermined low level and that causes the valve to close when the liquid level is at a predetermined high level.

The foregoing and other objects and features of my invention will be apparent and will be understood from the following detailed description of typical preferred forms and embodiments of the invention throughout which description reference is made to the accompanying drawings.

DETAILED DESCRIPTION OF THE INVENTION

Figure 1:
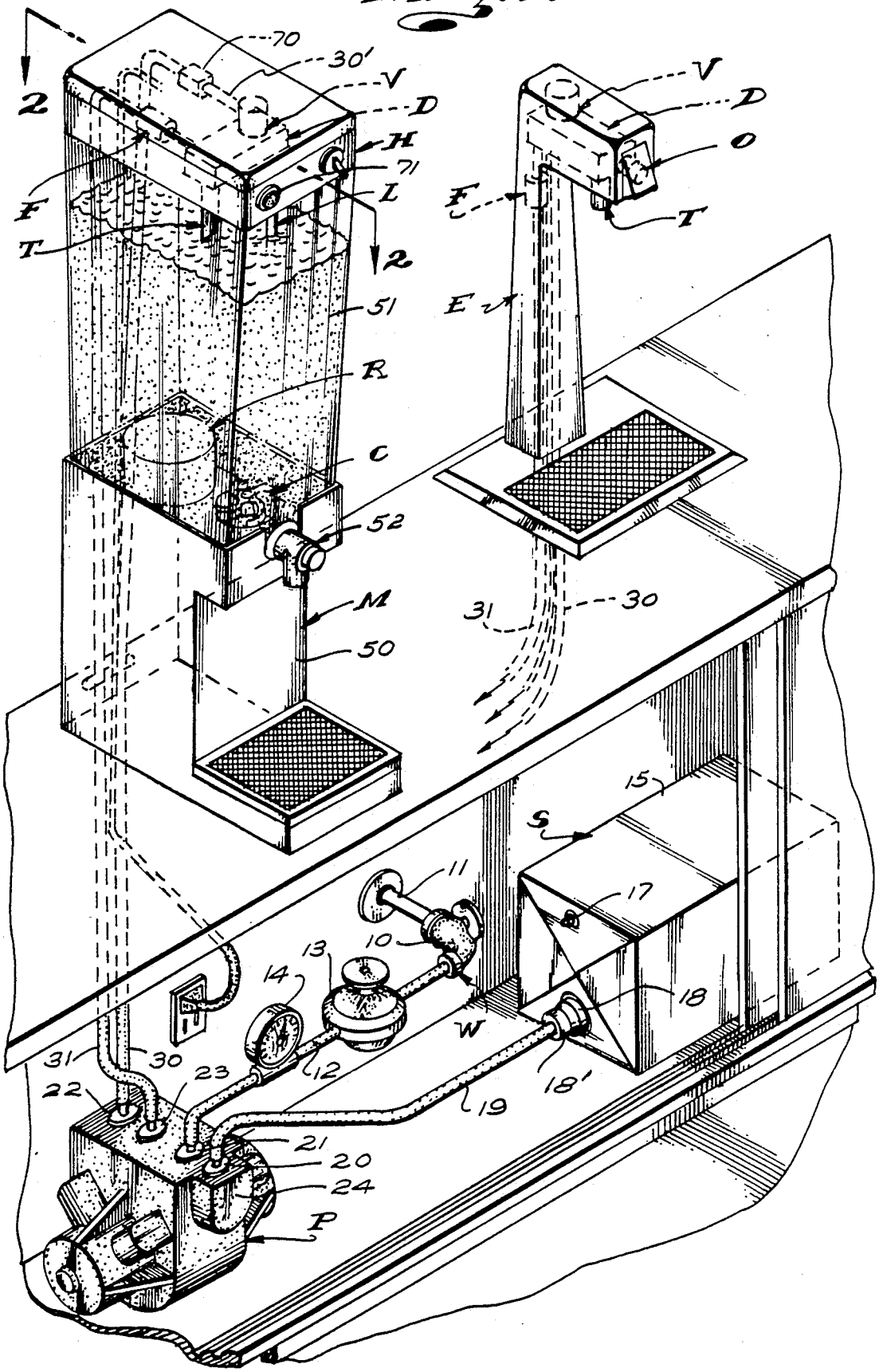
FIG. 1 is an isommetric view of an apparatus embodying the invention.
Figure 6:
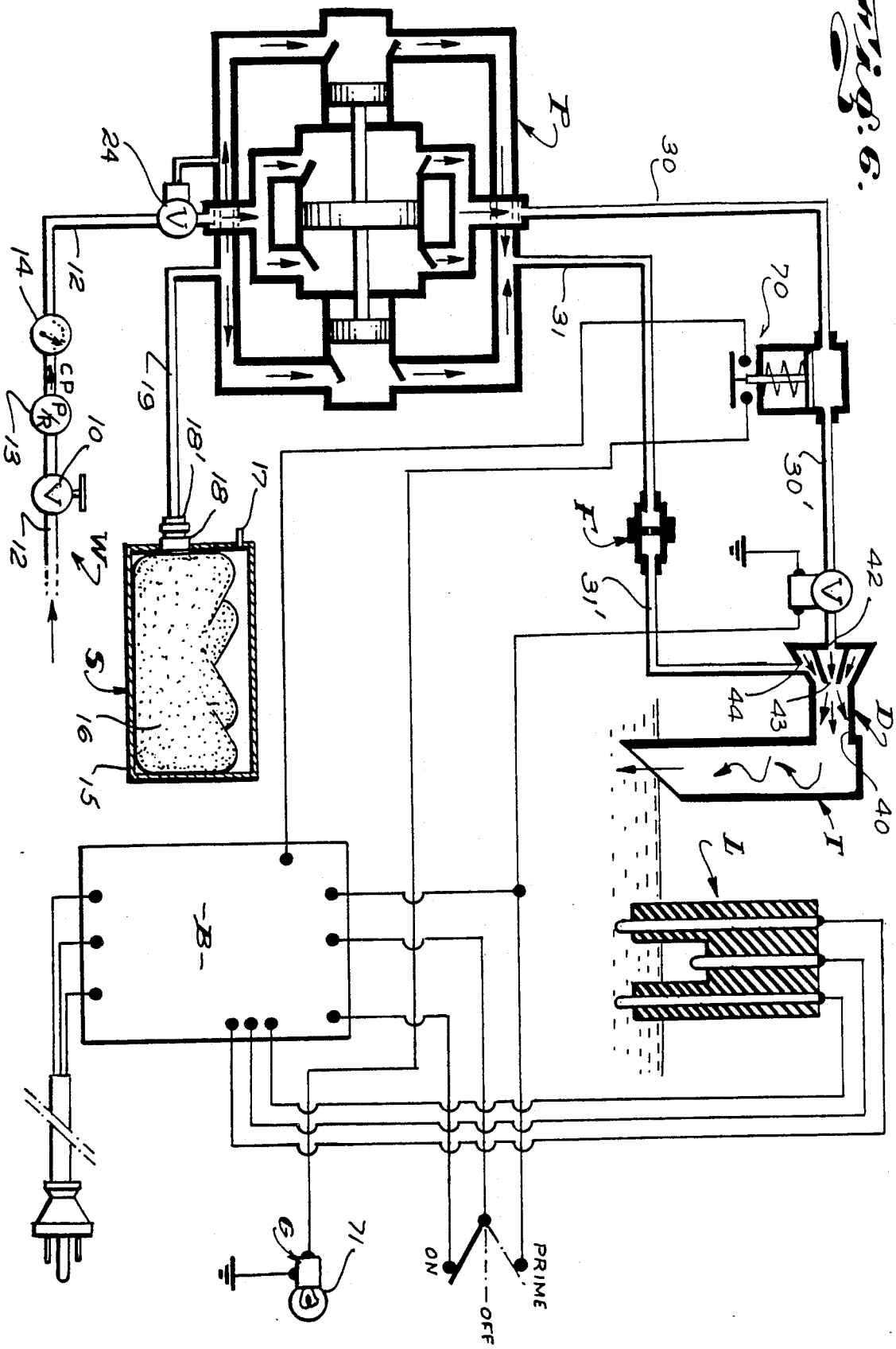
FIG. 6 is a diagrammatic view of the apparatus.

The embodiment of my invention shown in FIG. 1 of the drawings and which is diagrammatically illustrated in FIG. 6 of the drawings includes a high pressure water supply W comprising a hose bib or valve 10 at the end of a water service line 11. A water supply hose or line 12 is connected with the valve 10 and extends to and connects with a water inlet fitting 21 of a proportional pump P. In accordance with common practice, an adjustable pressure regulator 13 is engaged in the Line 12 and a pressure gauge 14 is engaged in the Line 12 downstream of the regulator 13.

The invention next includes a non-pressurized beverage syrup supply S. In the preferred carrying out of the invention, the syrup supply S is a bag-in-a-box container comprising an outer paper box-like carton 15 with an inner collapsible bladder 16 in which a supply of syrup is contained. The carton or container 15 is suitably vented as at 17. The bladder 16 has a fluid coupling part 18 that occurs at an opening in the container 15 and that is accessible at the exterior of the container. An elongate section hose 19 extends between the syrup supply S and the pump P and has a coupling part 18' at one end, coupled with the part 18. The other end of the Line 19 is connected with a syrup inlet fitting 20 of the pump P.

In the preferred embodiment of my invention, the pump P is that hydraulically powered proportional pump that is disclosed in and is the subject matter of U.S. Pat. No. 4,684,332 (fully identified above). The pump P, in addition to the water and syrup inlet fittings 20 and 21 noted above includes water and syrup outlet fittings 22 and 23 and further includes a normally open fluid pressure operated shut-off valve 24 at its water inlet side and that is responsive to the vacuum or minus pressure at its syrup inlet side. The valve 24 operates to stop the flow of water into and through the pump and to thereby put the pump out of operation when the minus pressure at the syrup inlet side of the pump drops below a predetermined minus pressure, as when the supply of syrup in the syrup supply S is exhausted and the bladder or bag 16 thereof collapses to seal across the fitting 18 and to stop the flow of all fluids to the syrup supply side of the pump.

Apart from the foregoing, it is sufficient to note that the pump P is a positive displacement pump that is driven by the water delivered to it and that is exhausted or delivered by it and that it operates to draw and to deliver volumes of syrup in a predetermined volumetric ratio to the volume of water moved through it. The pump is intended to be operated on water pressure between 20 and 45 psi and has been determined to operate most effectively and efficiently when driven by water at about 30 psi. In practice, since the pump is a positive displacement pump structure and ratio of water and syrup delivered by it is fixed, the pressure on the water and syrup delivered by it and downstream thereof is the same. Thus, if the pressure on the water at some point downstream of the pump is, for example, 25 psi, the pressure on the syrup at the same position downstream of the pump is 25 psi.

The invention next includes an aspirator-atomizer mixing device D that is positioned a substantial distance laterally from and vertically above the pump P. The device D can vary widely in details of design and construction and includes an elongate mixing chamber 40 with an inlet and a discharge end. The device D next includes an elongate water inlet passage 41 with an inlet end 42 that is suitably connected with the water outlet fitting 22 of the pump by an elongate water delivery hose or line 30. The passage 41 has an outlet or nozzle end 43 operating at the inlet end of the chamber 40. The nozzle end 43 is smaller in cross-section than the chamber 40 and is disposed to direct a jet of water axially through the chamber 40. The device D next includes a syrup inlet port 44 opening at the inlet end of the mixing chamber 40 and that communicates with an annulus that is defined by the side surface or wall of the chamber and the jet of water issuing from the nozzle end of the water passage 40. The jet of water flowing through the passage creates a minus pressure in the inlet end portion of the chamber 40 at the port 44. The port 44 is suitably connected with a related end of an elongate syrup delivery line or hose 31, the other end of which hose is connected with the syrup outlet fitting 23 of the pump P.

With the above relationship of parts, it will be apparent that when a jet of water is directed through the chamber 40, as noted above, a minus pressure is established in the chamber 40 thereby and that minus pressure draws or aspirates syrup in the line 31, downstream of the device D, into the chamber 40. The jet of water directed into and through the chamber 40, the syrup that is drawn into the chamber 40 and that air that occurs within the chamber 40 co-act to atomize the water and syrup and to substantially, completely co-mingle the atomized droplets of water and syrup so that a finished beverage is established thereby when the atomized liquids are let or caused to combine within or downstream of the outlet of the chamber 40.

It is to be noted that for the above atomizing of the water and syrup to occur within the chamber 40 of the device D, it is necessary that a substantial pressure differential be established on and between the water and syrup at the nozzle 43 and port 44 of the device during operation thereof.

It has been observed and is to be noted that in the absence of some suitable flow and/or pressure regulating means between the pump P and the device D the pump delivers both the water and syrup to the device D at the positive pressures and with insufficient pressure differential to assure complete and effective atomizing of the liquids. However, it has also been determined that under such circumstances the combined flow of water and syrup through and from the flow passage 40 of the device D does not materially reduce the aspirating effect of the device. That is, the motive force of the jet of water in and through the device continues to work to draw a negative pressure within the chamber 40 and downstream of the device D that works to draw or aspirate syrup through and from the pump P. The above noted drawing or aspirating of syrup from the pump P by the device D draws excess syrup through the pump P and renders the pump P ineffective and incapable of performing its intended function. That is, the pump P discontinues delivery of predetermined and properly portioned volumes of syrup and water.

Figure 2:
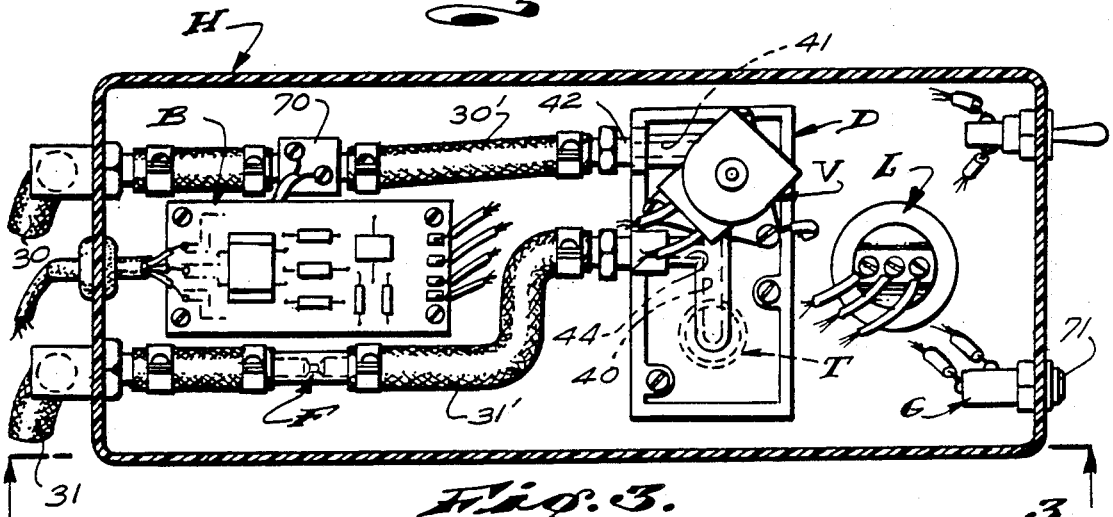
FIG. 2 is a view taken as indicated by Line 2—2 on FIG. 1.
Figure 3:
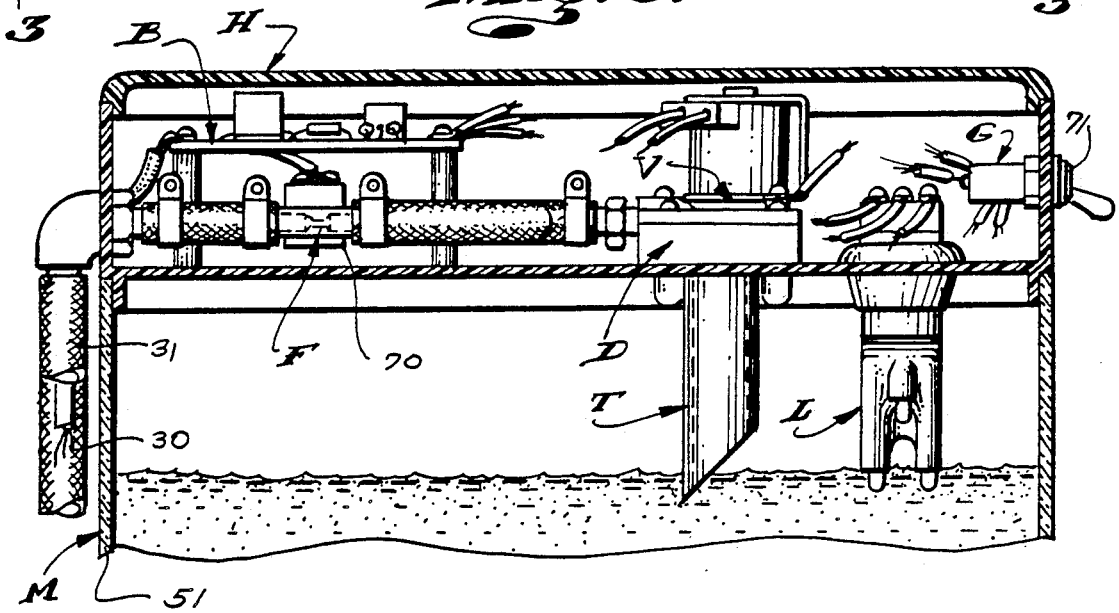
FIG. 3 is a view taken as indicated by Line 3—3 on FIG. 2.
Figure 4:
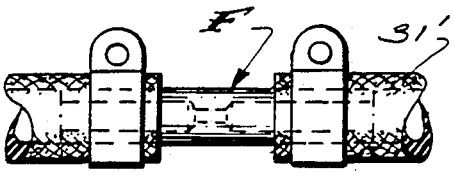
FIGS. 4 and 5 are views showing two forms of metering devices.
Figure 5:
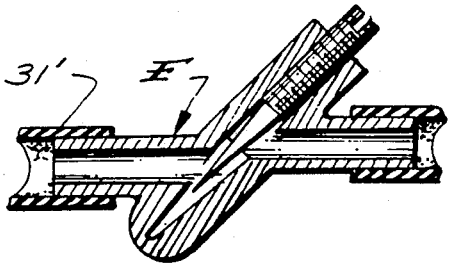

As a result of the above and in furtherance of my invention, the invention includes a flow metering device F positioned downstream of the port 44 of the device D. In FIG. 2 and 6 of the drawings, the device F is shown as a simple flow bean or orifice fitting engaged in the Line 31. In FIG. 5 of the drawings, I have shown a manually adjustable flow metering device F that might be advantageously used in carrying out my invention.

The flow meter device F is made or is adjusted to create a pressure drop between its upstream side and its downstream side so that a positive pressure is maintained on the syrup at the syrup outlet of the pump and a suitably reduced or minus pressure is maintained on the syrup at the port 44 of the device D. The reduced or minus pressure downstream of the device F is such that a sufficient pressure differential is established on the water and syrup at the nozzle 43 and port 44 of the device D to cause desired atomizing of those liquids as they move downstream in the mixing chamber 40 of the device.

It is to be noted that the flow metering device F is not such that it meters the flow of syrup in a manner that might interfere with the function of the pump P to deliver properly portioned volumes of water and syrup. Its only functions are to, in effect, isolate the device D from the pump so that the device D does not draw a minus pressure on the syrup at the pump and to establish the noted pressure differential at the device D, while allowing for free and full volumetric flow of the syrup delivered by the pump to the device D.

In practice, the device F is capable of maintaining a necessary positive pressure on the syrup at the outlet of the pump P through a wide range of pressures and is such that it need not be finely adjusted and/or made such that it might adversely restrict the free flow of syrup delivered by the pump to the device D. This is because the positive pressure required to be maintained on the syrup, at the outlet of the pump P, need not be more than 1 psi while the pump normally operates to deliver syrup at substantially greater pressures. For example, if the normal pressure on the syrup at the syrup outlet of the pump is 10 psi, the device D can operate to aspirate and draw syrup at a rate that will lower the pressure on the syrup at the outlet of the pump to but 1 psi without any adverse effects. In such a case, the proportional delivery of water and syrup by the pump is not affected and the device D aspirates and effectively atomizes the whole of the syrup and water delivered by the pump.

While I have yet to determine how or why the pump P fails to deliver properly portioned volumes of water and syrup when a minus pressure is imposed upon the syrup at its syrup outlet, empirical evidence points to the fact that certain of the sealing rings and/or certain of the valves in the pump leak and/or become unseated, with adverse effects, when subjected to such a minus pressure.

In furtherance of my invention, I have shown the device D as including an electrically operated and on-off valve V in the water passage 41 upstream of the nozzle 44 and have shown the device D as including an elongate vertically extending downwardly opening beverage delivery tube T at the outlet end of the mixing chamber 40.

In my reduction to practice of the invention, the device D is that liquid metering and mixing aspirator unit that is disclosed in and which is the subject matter of U.S. Pat. No. 4,468,137 issued to myself on Sept. 4, 1984.

The valve V of the device D is operated to start and stop the flow of water into and through both the device D and the pump P and to thereby start and stop operation of the apparatus as desired or as circumstances require.

The delivery tube T is provided and operates to collect and cause the atomized particles of water and syrup flowing from the chamber 40 of the device D to combine to make a finished beverage and to allow that beverage to drain downwardly from it.

The tube T prevents free uncontained spraying and broadcasting of the atomized liquids as they move downstream from within the chamber 40.

In furtherance of my invention, the apparatus is shown as including a non-carbonated beverage dispensing machine M of that class that is characterized by a service counter supported base 50 and an upwardly opening transparent beverage supply tank 51. The tank 51 is shown as having a manually operable dispensing valve 52 at its lower end.

In accordance with common practice, the machine M can be equipped with refrigeration means R to chill the beverage stored in its tank and can be equipped with beverage circulating means C to maintain the beverage in the tank circulating. Since the above means do not directly affect the invention, I have elected not to burden this disclosure with detailed illustration and description thereof.

In the form of the invention illustrated, the machine M is shown supported atop a serving counter and the syrup supply S and pump P are stored in a space beneath the counter. The water delivery line 30 and syrup delivery hose 31 extend from the pump P to the top of the tank 51 where they meet a housing H in which the devices D and F are arranged and supported, as shown. The housing H is removably engaged stop the tank 51 to normally close the open top thereof. The line 30 and hose 31 are shown as having end portions or sections 30' and 31' that occur within the housing H and that connect with the devices D and F. The sections 30' and 31' extend to the exterior of the housing H where they are suitably releasably connected with the line 30 and hose 31, as shown.

In the preferred carrying out of my invention, the apparatus next includes a liquid level responsive switching device L carried by the housing H and depending into the liquid (beverage) in the tank 51 of the machine M and that is suitably connected with the valve V of the device D. The device L operates to close a circuit to the valve V and cause the valve to open and to put the apparatus into operation when the liquid level in the tank reaches a predetermined low level and to open the circuit to the valve V to cause the valve to close and to put the apparatus out of operation when the liquid level in the tank T reaches a predetermined high level. With the above noted device L, the apparatus is automatically put into and out of operation to maintain the supply of liquid beverage in the tank T between predetermined high and low levels, at all times.

The device L can be any one of a number of different kinds of liquid level responsive switching devices commonly used in the art to control the operation of automatic liquid supply means for the beverage supply tanks of beverage dispensing machines. For the purpose of this disclosure, the device L is shown as including a vertical column depending from the housing H into the tank 51. The column has three vertically and laterally spaced terminals that are contacted by the liquid in the tank when the liquid is at different levels and that are connected with the valve V, through and/or by means of a suitable circuit board B within the housing, to effect opening and closing of the valve V, as desired and as described above.

In furtherance of my invention, I provide novel signalling means G to signal the user or operator of the apparatus when the supply of syrup in the syrup supply S is exhausted. The means G includes a normally open pressure actuated switch 70 engaged in the section 31' of the water line 30 within the housing H. The switch 70 is held and maintained open by the water pressure in the line 30, so long as the apparatus is in operating condition. When the supply of syrup is exhausted and the water shut-off valve 24 of the pump P closes, as noted in the preceding, the pressure on the water in the line 30 drops and the switch 70 closes. The switch is connected with a signal lamp 71 carried by the housing 80 and energizes that lamp when it closes. Accordingly, when the syrup supply is exhausted, the lamp 71 is energized and signals or warns the operator of the apparatus that the apparatus is out of operation and requires a new or fresh supply of syrup.

In another embodiment of my invention shown in FIG. 1 of the drawings, the machine M is not included and the devices D and F are housed within the upper end of an elongate vertical column or "tower" E carried by and projecting upwardly from the serving counter 60 and which is operable to direct finished beverage from the device D directly into serving glasses or the like. In this modified embodiment of the invention, the valve V of the device D is manually operated to open and close by means of a manually operable switch device O accessible at the top of the column or tower.

The above modified embodiment of the invention is unique in that it is capable of making and dispensing properly finished fruit-flavored beverages that contain substantial amounts of fruit fiber and the like, a serving at a time. The foregoing is made possible by and through use of an aspirator-atomizer mixing device that is capable of effectively handling fiber laden syrup (without fouling) and that effectively completely mixes water and syrup so that finished beverages are dispensed thereby. It is also dependent upon and made possible by and through the use of an aspirator-atomizing mixing device that includes a dispensing tube T that functions to collect and combine atomized liquids into finished beverages that drain directly down in and from the tube in a manner that allows the beverages to be effectively delivered into waiting glasses or serving containers.

Having described only typical preferred forms and embodiments of my invention, I do not wish to be limited to the specific details herein set forth but wish to reserve to myself any modifications and/or variations that might appear to those skilled in the art and which fall within the scope of the following claims.

Having described my invention, I claim:

1. A beverage making and dispensing apparatus comprising a pressurized water supply; a non-pressurized beverage syrup supply; a hydraulically driven proportional pump with a water inlet connected with the water supply, a syrup inlet connected with the syrup supply, a water outlet connected with a water delivery line and a syrup outlet connected with a syrup delivery hose; the pump is driven by water from the water supply and operates to draw syrup from the syrup supply and to deliver water and syrup in predetermined ratio into and through the line and the hose; an aspirator-atomizer mixing device spaced from the pump, the mixing device defines an elongate mixing chamber with inlet and outlet ends, a water passage with an inlet end connected with the delivery line and a nozzle end opening at the inlet end of the chamber to direct a jet of water longitudinally of the chamber, a syrup port communicating with the inlet end portion of the chamber and connected with the hose; a water valve to start and stop the flow of water through the pump and the mixing device; and, a flow-control device upstream of the syrup port operating to establish a pressure drop from the upstream to the downstream side thereof and to maintain positive pressure on the syrup at the syrup outlet of the pump and a pressure on the syrup at the port in the mixing device that is less than the pressure at the nozzle end of the water passage.

2. The apparatus set forth in claim 1 that further includes an elongate vertical dispensing tube with an upper end connected with the outlet end of the chamber and a downwardly opening dispending end.

3. The apparatus set forth in claim 1 wherein the water valve is a normally closed electrically operated on-and-off valve engaged in the water passage of the mixing device and that is operated to open upon closing of a related switch device.

4. The apparatus set forth in claim 1 wherein the water valve is a normally closed electrically operated on-and-off valve engaged in the water passage of the mixing device and that is operated to open upon closing of a related switch device, an elongate vertical dispensing tube with an upper end connected with the outlet end of the chamber and a downwardly opening dispensing end.

5. The apparatus set forth in claim 1 that further includes a beverage dispensing machine with an upwardly opening beverage supply tank positioned remote from the pump and the syrup supply, the mixing device is positioned at the open top of the tank.

6. The apparatus set forth in claim 1 that further includes a beverage dispensing machine with an upwardly opening beverage supply tank positioned remote from the pump and the syrup supply, the mixing device is positioned at the open top of the tank, the water valve is a normally closed electrically operated on-and-off valve engaged in the water passage of the mixing device and that is operated to open upon closing of a related switch device.

7. The apparatus set forth in claim 1 that further includes a beverage dispensing machine with an upwardly opening beverage supply tank positioned remote from the pump and the syrup supply, the mixing device is positioned at the open top of the tank, the water valve is a normally closed electrically operated on-and-off valve engaged in the water passage of the mixing device and that is operated to open upon closing of a related switch device; said apparatus further includes an elongate vertical dispensing tube with an upper end connected with the outlet end of the chamber, and a lower open end portion depending into the tank.

8. The apparatus set forth in claim 1 that further includes a beverage dispensing machine with an upwardly opening beverage supply tank positioned remote from the pump and the syrup supply, the mixing device is positioned at the open top of the tank, the water valve is a normally closed electrically operated on-and-off valve engaged in the water passage of the mixing device and that is operated to open upon closing of a related switch device.

9. The apparatus set forth in claim 1 that further includes a beverage dispensing machine with an upwardly opening beverage supply tank positioned remote from the pump and the syrup supply, the mixing device is positioned at the open top of the tank, the water valve is a normally closed electrically operated on-and-off valve engaged in the water passage of the mixing device and that is operated to open upon closing of a related switch device, the switch device is a liquid level responsive switch device position in the tank and operates to close when the liquid level in the tank lowers to a predetermined low liquid level and that operates to open when the liquid level in the tank is raised to a predetermined high liquid level.

10. The apparatus set forth in claim 1 that further includes a beverage dispensing machine with an upwardly opening beverage supply tank positioned remote from the pump and the syrup supply, the mixing device is positioned at the open top of the tank, the water valve is a normally closed electrically operated on-and-off valve engaged in the water passage of the mixing device and that is operated to open upon closing of a related switch device, the switch device is a liquid level responsive switch device position in the tank and operates to close when the liquid level in the tank lowers to a predetermined low liquid level and that operates to open when the liquid level in the tank is raised to a predetermined high liquid level; said apparatus further includes an elongate vertical dispensing tube with an upper end connected with the outlet end of the chamber, and a lower open end portion depending into the tank.

* * * * *